United States Patent [19]

Newman et al.

[11] Patent Number: 4,693,472

[45] Date of Patent: Sep. 15, 1987

[54] BALL REBOUND NET

[76] Inventors: Vernon H. Newman, 107 Hazel Road, Lakes Entrance, Victoria 3909; Roland Becker, 26Munro Street, Brighton, Victoria 3186, both of Australia

[21] Appl. No.: 705,335

[22] PCT Filed: Jun. 15, 1984

[86] PCT No.: PCT/AU84/00104

§ 371 Date: Feb. 8, 1985

§ 102(e) Date: Feb. 8, 1985

[87] PCT Pub. No.: WO85/00019

PCT Pub. Date: Jan. 3, 1985

[30] Foreign Application Priority Data

Jun. 15, 1983 [AU] Australia ..... PF9819
Jun. 16, 1983 [AU] Australia ..... PF9846
Dec. 8, 1983 [AU] Australia ..... PG2755

[51] Int. Cl.[4] ..... A63B 69/40

[52] U.S. Cl. ..... 273/29 A; 273/26 A; 273/395

[58] Field of Search ..... 273/26 A, 29 BC, 29 B, 273/181 F, 181 J, 410; 256/37, 42, 43, 67, 65, 395

[56] References Cited

U.S. PATENT DOCUMENTS

| | | | |
|---|---|---|---|
| 1,142,284 | 6/1915 | Lawrence . | |
| 2,992,002 | 7/1961 | Bingham, Jr. . | |
| 3,013,801 | 12/1961 | Kirkconnell | 273/26 A |
| 3,312,467 | 4/1967 | Dawson . | |
| 3,711,092 | 1/1973 | Hague | 273/26 A |
| 4,206,916 | 6/1980 | Epply . | |
| 4,410,313 | 2/1979 | Martin . | |
| 4,456,251 | 6/1984 | Balaz . | |

FOREIGN PATENT DOCUMENTS

| | | | |
|---|---|---|---|
| 271484 | 4/1964 | Australia . | |
| 6152780 | 2/1981 | Australia . | |
| 7223451 | 1/1980 | Fed. Rep. of Germany . | |
| 540205 | 7/1922 | France | 273/29 B |
| 2259089 | 12/1983 | France . | |
| 80/4974 | 8/1980 | South Africa . | |
| 119668 | 9/1947 | Sweden | 256/37 |
| 379260 | 8/1933 | United Kingdom | 273/26 A |
| 929247 | 6/1963 | United Kingdom . | |

*Primary Examiner*—Richard C. Pinkham
*Assistant Examiner*—T. Brown
*Attorney, Agent, or Firm*—Laubscher & Laubscher

[57] ABSTRACT

This invention provides a rebound net, for use in practising tennis, cricket, baseball and/or other games, having a surrounding frame and a net capable of being mounted in the frame, the net being made of a tough, low-extensible material such as nylon with the threads of the net fastened together at their intersections, and a number of attachment clips for fastening said net to the frame, when the attachment clips are arranged around the frame, in such manner as to hold the net under tension sufficient to provide at least 80% rebound in a tennis ball when dropped upon a mid-portion of the net in horizontal position. The net is arranged so that the threads thereof, when the net is held in the frame under tension, extend from the bottom of the frame upwardly on opposite sides of a vertical center line at equal angularity to that center line. That is to say, for a net with a square mesh the diagonals of the mesh extend horizontally and vertically when the frame is in an upright operative position. Preferably, the attachment clips permit of individual adjustment, or tuning, of the net tension at the different locations of the clips.

10 Claims, 12 Drawing Figures

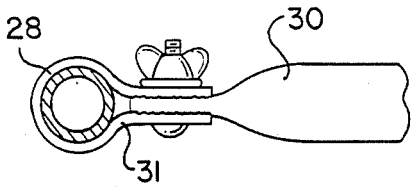
FIG. 3
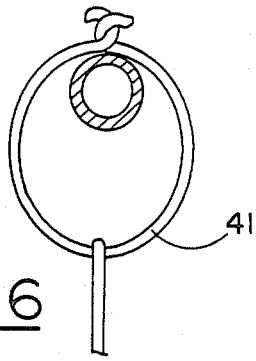
FIG. 6
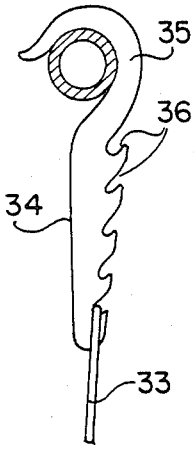
FIG. 4
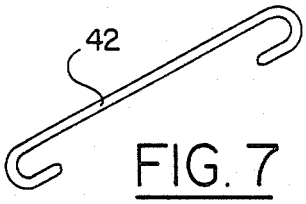
FIG. 7
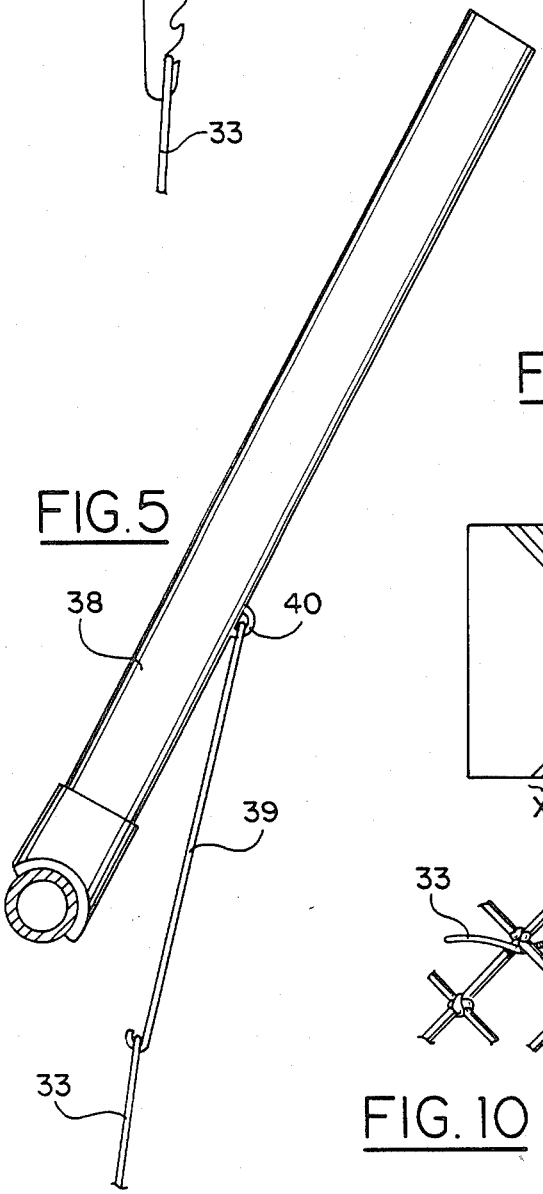
FIG. 5
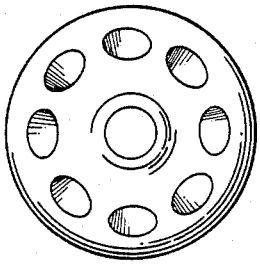
FIG. 9
FIG. 11
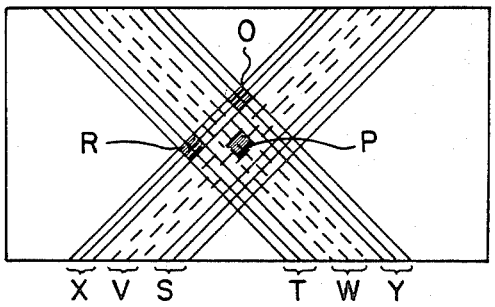
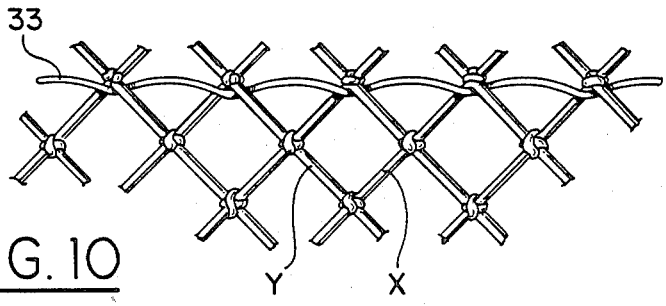
FIG. 10

BALL REBOUND NET

This invention relates to rebound and like devices for use e.g. in the playing and/or practicizing of tennis and other ball games, and being of the kind including a net tensioned in a frame.

In the past it has often proved impossible to achieve a suitably high tension consistent with realistic rebound characteristics.

SUMMARY OF THE INVENTION

An object of our invention is to provide a high-tensile, simple, lightweight, portable, versatile and easily assemblable and disassemblable construction capable of withstanding and supporting a relatively high and substantially sustained net tension, and to provide, in particular, for appropriate summation of rebound forces with a multiplicative effect, and interaction and co-operation between net and frame whereby, upon appropriate "inter-tuning"between the frame, net, and ancillary components, superior rebound characteristics are combined with high efficiency and convenient adjustability to suit a wide variety of circumstances and space exigencies.

With this object in view our invention in a preferred form provides a rebound net wherein a net of tough and low-extensible material exhibiting substantial non-slip characteristics when conventionally or suitably knotted (e.g. a plastics/monofilament of suitable cross-section) is held by a means of a high-tensile and substantially non-stretch perimeter cord, such cord, being of the same, similar or compatible material with that of the net, within a tubular metal or like material framework by means of clips or other suitable attachment anchoring or constraining devices characterized in that the net and perimeter cord are tensioned to a high degree, sufficient to provide at least 80% rebound of a tennis ball (i.e., with less than a 20% loss of kinetic energy).

The net material may be "Nylon" monofilament or material of similar physical characteristics e.g. strain/stress function and/or elastic memory function. The perimeter cord may be of the same or similar material of suitably larger area cross-section. Preferably the perimeter cord is such as will not extend more than about 0.5% at maximum load whilst retaining elasticity.

The net filaments may be of double-circular, "dumbbell" or bilobular cross-section represented approximately by two circles joined by a narrower "bridge", and it is thought at this stage that the opposed "valleys" of the filament thus produced will assist the stability of knotting of such material.

The knotting may be a double-knotting or any other manner or means of non-slip or substantial non-slip connexion to prevent undue deformation of the mesh pattern and hence reduce any risk of the ball passing through the net even at the highest tensions and impact speeds permitted by the device.

Similarity or compatability of the perimeter cord material with that of the net, may tend to reduce the risk of cutting and abrasion, particularly at high-tension.

BRIEF DESCRIPTION OF THE DRAWING

In order that the invention may be readily understood and conveniently put into practical effect an exemplary construction of rebound net made according to the invention will now be described with reference to the accompanying drawings wherein:

FIG. 3 shows a cross-section on the line and in the direction of the arrows 3—3 of FIG. 1*b;*

FIG. 4 illustrates a preferred construction of attachment clip for holding the perimeter cord in relation to the frame;

FIG. 5 shows one tensioning device, for use in connecting the perimeter cord to an attachment clip or for tension adjustment purposes;

FIG. 6 illustrates a second form of attachment clip;

FIG. 7 shows a corner brace;

FIG. 9 shows a multi-purpose connector for the members of the net frame;

FIG. 10 illustrates the construction of the net and the connection of the perimeter cord thereto; and FIG. 11 depicts diagrammatically areas of the net tuned to provide for different tensions in the net and, therefore, different rebound characteristics.

DETAILED DESCRIPTION

Figure 1A:
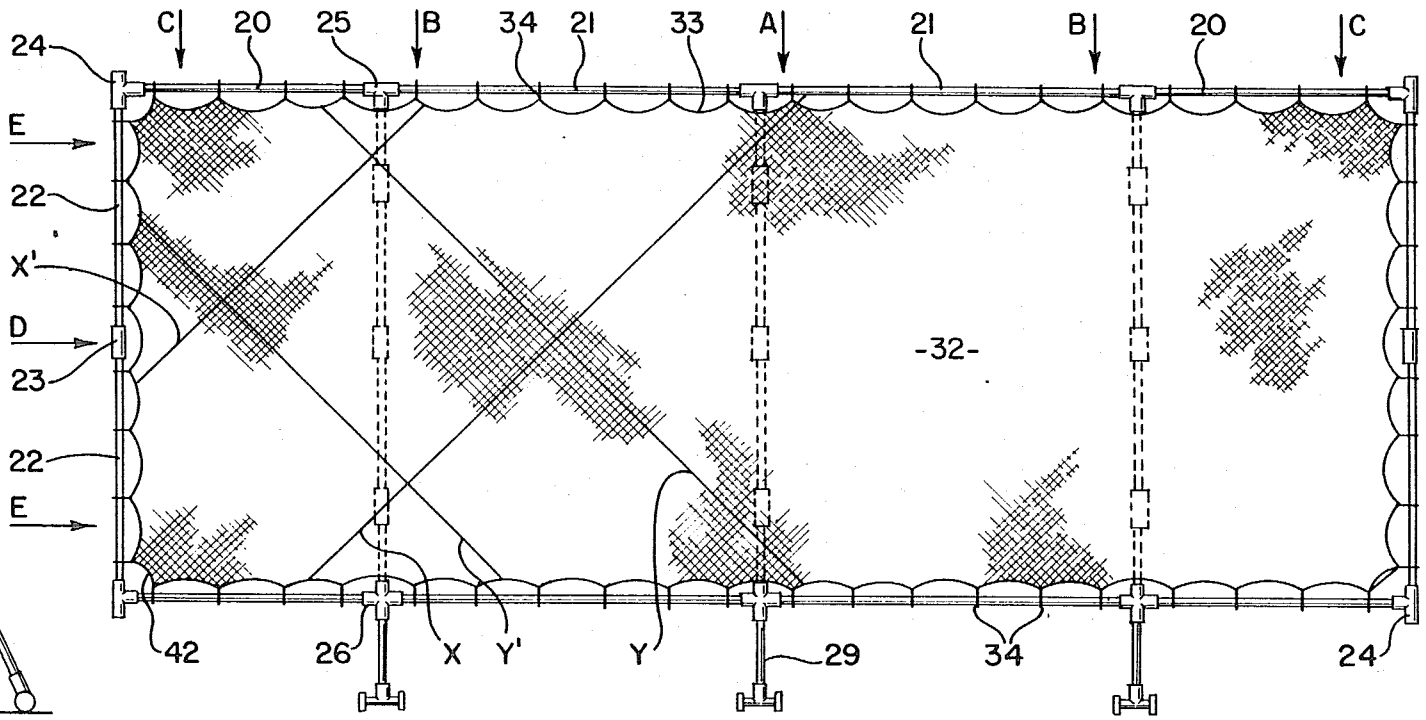
FIG. 1*a* is a front elevation of the rebound net, mounted ready for use.

The net frame, illustrated particularly in FIGS. 1*a,* 1*b* and 2 consists of a number of tubular metal members 20, 21, 22 connected together in rectangular arrangement by parts 23, 24, 25 and 26. Strengthening frame members 27, 28 are connected to the rectangular net frame by the connector parts 25 and 26, and leg members 29 are attached to the parts 26. A support leg 30 is attached to each of the strengthening frames 27, 28 by an angularly adjustable connector 31, shown particularly in FIG. 3. The leg members 29 and support legs 30 operate to hold the net frame at a set height, and the support leg may be adjusted angularly relative to the net frame so that said net frame may be supported at any desired angle relative to the ground-vertical or inclined to the vertical.

The net, indicated generally by the numeral 32, is made of a number of threads X and Y tied together at each intersection. Preferably, we use a 30 gauge, dumbbell section nylon double knotted and—for tennis, cricket or baseball practice—3 inch or 76 mil. (approx.) square mesh—that is to say, each side of the square mesh is 1½ inches or 38 mil., approximately. Naturally, the size of the mesh, when extended under tension, must be smaller than the ball to be hit or thrown against it, so that the ball will not catch in or pass through the net.

The net 32 has a perimeter cord 33 passed through the apexes of the meshes around the periphery of the net, as illustrated in FIG. 10, and the opposite ends of that cord are secured together. It is believed the perimeter cord should have a breaking strain in excess of 600 lbs., and in one construction used by us the perimeter cord was 3 mil. in diameter, of nylon, and having a breaking strain of about 800 lbs. or 364 kg.

The net 32 is arranged in the frame 20, 21, 22 with the threads X and Y extending angularly, as shown in FIG. 1*a* such that, in the main part of the rebound net, the threads X and Y will be substantially the same length and, therefore, subjected to the same strains when deflected the same distance from the general plane of the net. Naturally, the threads will be of lesser length in the corner portions of the net, as indicated by the threads X′ and Y′.

We believe it is desirable that if a ball strikes centrally, or squarely, into a mesh of the net that all four sides of that mesh be subjected to the same strain when that mesh is deflected from the general plane of the net. If the threads of the net extend horizontally and vertically, in a rectangular frame of greater horizontal length than vertical height, the horizontal threads will be longer than the vertical threads and the strains in the threads will not be uniform when deflected.

In order to hold the net 32 in the surround frame, and to provide means for applying a desired high tension in the net, we provide a number of attachment clips 34, as shown in FIG. 4. Each of these clips has a hook 35 for engagement with a frame member 20, 21 or 22 and a number of jaws 36 arranged at spaced intervals for engagement with the perimeter cord. In fastening the net 32 into the frame the perimeter cord 33 may be engaged in the lower jaws 36 of a number of clips 34 arranged along the top of the frame, then in the corresponding jaws 36 of a number of clips 34 arranged along the bottom of the frame, then in the innermost jaws of a number of clips 34 connected to one end of the frame and then into the innermost jaws of clips 34 attached to the other end of the frame.

To apply a desired tension to the perimeter cord 33 and to the net 32 the cord may be engaged in the next-adjacent jaw 36 of each clip in series until a deisred tension has been applied to the net as a whole. Alternatively, or in addition, further clips 34 may be used so as to apply tension to the net at a greater number of locations.

As the perimeter cord 33 is fastened relative to the frame at spaced intervals it, and the peripheral portion of the net 32, will assume a shallow scalloped or segmental shape, by reason of the tension in the net 32.

Figure 1B:
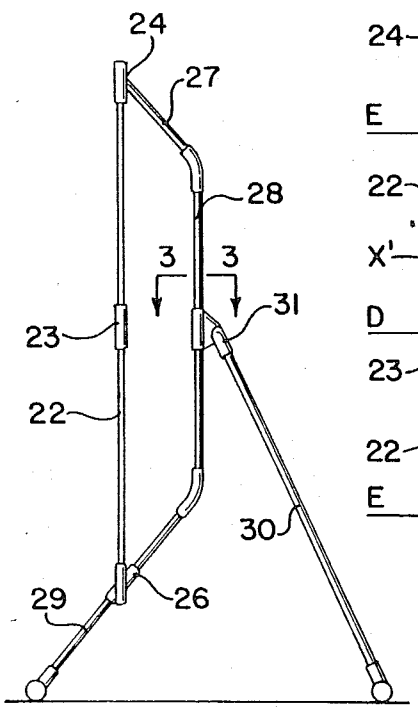
FIG. 1*b* shows the mounted rebound net in side elevation.

We have found that with a frame of 5 meters in length and 2 meters in height, with 24 clips arranged along each of the top and the bottom of the frame, spaced every 5 meshes of the net, and with 12 clips at each end, spaced every 3 meshes of the net, we can achieve net tensions as follows, at the locations indicated by the arrows A, B, C, D, and E in FIG. 1:

At location A—12 kg. or 26.4 lbs., approx.
At locations B—14 kg. or 30.8 lbs., approx.
At locations C—18 kg. or 39.6 lbs., approx.
At location D—16 kg. or 35.2 lbs. approx.
At locations E—18 kg. or 39.6 lbs., approx.

These tensions, we believe, are approximately the optimum for use with a tennis ball but may be increased for using the rebound net with a cricket ball, a baseball or other relatively solid ball less likely to distort than a tennis ball. Obviously, lower tensions—such as 8 kg.—may be satisfactory in some usages and higher tensions—such as 20 kg.—will be required in others. It is believed that, for a tennis ball, an increase in the tensions given above will result in a lower or lesser rebound.

The total tension applied to the net 32 is quite high, and the frame members 20, 21 and 22 tend to bow under that tension, applying a resilient spring loading to the net 32. Accordingly, the frame members should have a degree of resiliency, as well as high strength. For that reason, steel is their preferred material.

To check the rebound characteristics of that net, under that tension, we placed the rebound net and frame in a horizontal position and dropped a standard, approved, tennis ball on the middle of the net from a height of 10 feet (approx. 3.05 meters) and noted a rebound of 9.2 feet (approx. 2.81 meters)—that is 92%.

The tensions at the corners of the net are substantially higher than those mentioned and it may be found desirable to attach corner braces 42, such as shown in FIG. 7, to the attachment clips at the corners, so as to hold them in position relative to the frame, as shown in FIG. 1*a*.

Also, it may be necessary to use a tensioning device, such as shown in FIG. 5, in pulling the perimeter cord 33 into engagement with the attachment clips 34, or any of them. This tensioning device comprises a handle 38 made to engage a tubular frame member at its inner end and a hook 39 pivotally attached to the handle at 40, the hook being readily engageable with the perimeter cord 33. Such a device may be required in attaching the perimeter cord 33 to the clips 34 at the corners of the frame, in particular, though it may also be used advantageously at other locations.

A modified construction of attachment clip, 41, is shown in FIG. 6. This clip does not provide for adjustment of the tension in the net, so is made an effective length to suit the tension which is required in the net 32.

It is clear from the above description of the frame and net of the rebound net that it may be readily made for sale in "Kit" form, and that there may be a basic arrangement of the frame to which additional units may be added from time to time in order to build up a greater arrangement of net configurations, as shown at B, C, E and G in FIG. 8. Also, the frame may be made in proportions other than illustrated in FIGS. 1 and 2, such as shown at D, F, H and I in FIG. 8.

Figure 2:
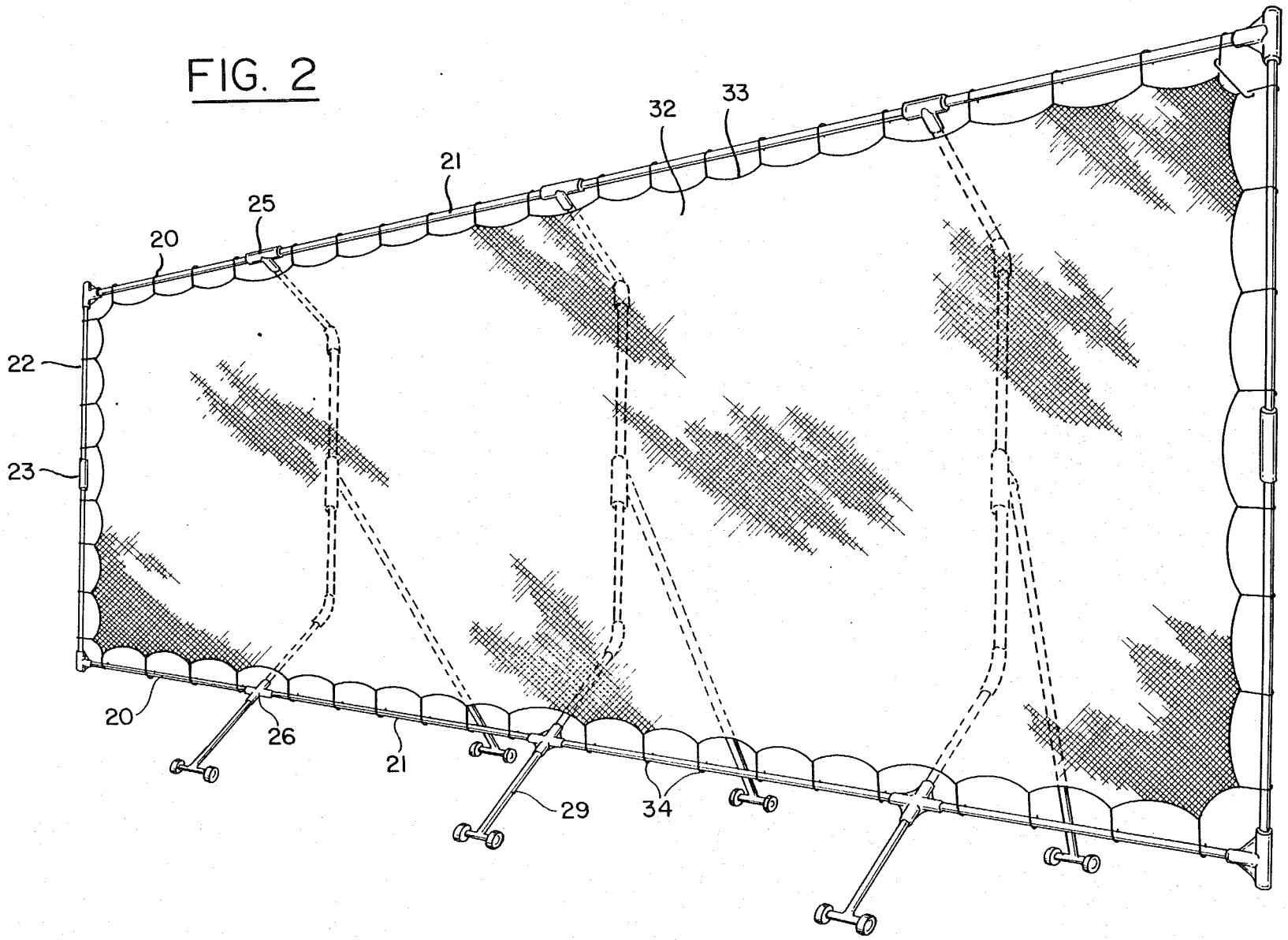
FIG. 2 is a perspective view.
Figure 8A:
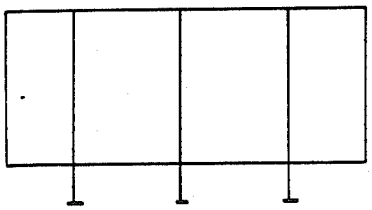
FIG. 8 illustrates a number of different arrangements of rebound nets, for different purposes.
Figure 8B:
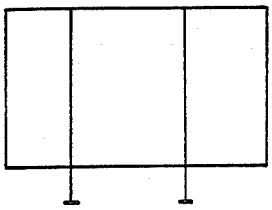
Figure 8C:
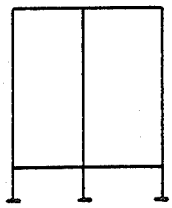
Figure 8D:
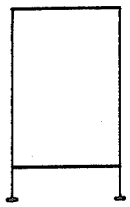
Figure 8E:
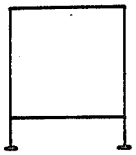
Figure 8F:
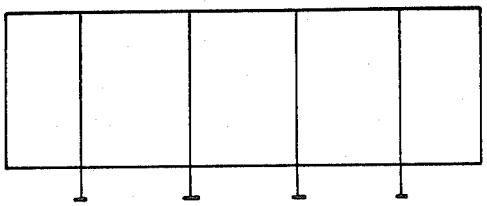
Figure 8G:
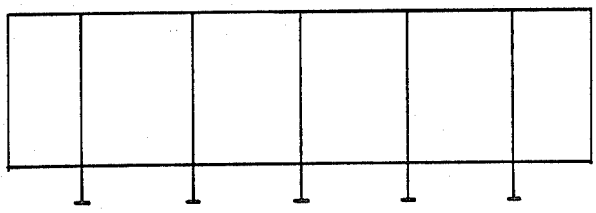
Figure 8H:
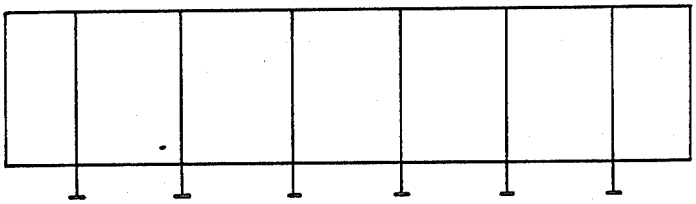
Figure 8I:
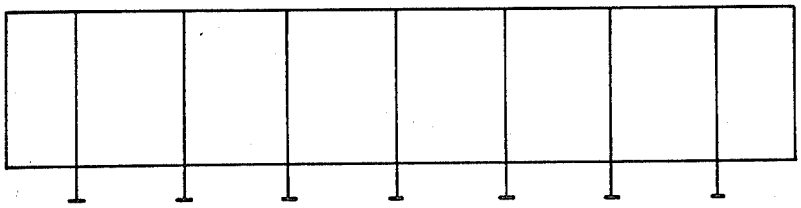

Should it be desired to have a multi-purpose connector for joining together the several parts of the frame and support means a member such as shown in FIG. 9 may be provided, such member having means for engagement with the tubular frame members at a number of different angles, as with such frame members being in line, as are the members 21 in the top and bottom of the frame, at right angles, as are the members 20 and 22 at a corner of the frame, or at an angle as are the members 21 and 27. However, it is preferred to provide the simpler, standard, pipe connections as shown in FIGS. 1 and 2.

Straight pipe connections, such as 23, may be used for extending or retracting the frame if the adjacent ends of adjacent frame members—such as the end members 22—are screw-threaded in opposite directions, left-hand and right-hand, and the pipe connections are made to suit as well as being provided with means—such as capstan holes—whereby they may be turned when under pressure. By such means the end members 22, for example, may be forced apart so as to increase the overall height of the frame and thereby increase the tension in the net 32. Similar connectors may be provided at intermediate locations in the frame members 20 and 21, so that the overall length of the frame may be increased.

However, it is considered that the tensioning of the net 32 by use of an appropriate number of clips for attaching the net to the frame, and by drawing the net closer to the frame so as to increase tension (or allowing it to retract from the frame to reduce tension) will permit of adequate tuning of the net and the frame to ensure correct tension in the net at any location so as to obtain desired rebound characteristics and permit the net to be tensioned to suit particular requirements—as for use with a tennis ball, or with a cricket ball, or baseball, and so on.

Also, the net may be tuned to provide areas of unequal or differing tensions, as illustrated somewhat diagrammatically in FIG. 11. As depicted in that FIGURE there are three threads Y and three threads X of substantially equal tensions which intersect or cross at an area O, three threads W and three threads V of substantially equal tension, which is somewhat lower than the tension in the threads X and Y, intersecting at an area P; and there are three other threads T and three threads S of still lesser tension, the threads T intersecting the threads X at an area R. A tennis ball hitting the area O should have rebound characteristics differing from those exhibited if the same ball strikes the area P at the same velocity and from the same direction; and if the ball hits the area R, composed of threads X and T at different tensions, the rebound should be different again.

Thus, the rebound net provided by this invention may be tuned to provide for variations in the rebound of a ball according to the locality of the net struck by the ball.

If the perimeter cord is made of a relatively inextensible material, as herein described, it is clear it's effective length must be pre-calculated to accord with the internal dimensions of the surround frame. Thus, if it is desired that the net extend to within, say, 2 inches (approx. 5 cm) of the inner surfaces of the surround frame when correctly tensioned it will be necessary for the effective length of the perimeter cord to be approximately 16 inches (approx. 40 cm) shorter than the internal periphery of the frame.

However, it may be that the perimeter cord is made of a material which will stretch with the passage of time and it may be necessary to provide means for taking up any such stretch as does occur. For that purpose we may provide a simple winch mechanism at one corner of the frame and the perimeter cord may be attached securely at one end to the frame adjacent the winch, threaded through the peripheral portion of the net and its opposite end firmly connected to the winch whereby, by operation of the winch, any extension of the cord may be taken up and the tension maintained in the cord.

We believe that, in a rebound net, it is desirable for the force of rebound to be provided by the net itself, rather than by the ball as happens when a tennis ball is hit against a solid wall. We also believe that when using a rebound net, as described above, impact of the ball tends to pull the cord locally inwards, in four peripherally spaced regions.

It is believed that best results may be obtained by adjusting the vertical and horizontal tensions such that, during its brief contact with the net, the ball makes an impression or "well" which, however deep, is substantially circular in section and relatively small in extent. The effects of the encounter and the reaction of the net may therefore be relatively localized, with minimum nett transfer of energy from the ball to the net.

The effective shape of this "well" (for any particular projectile, impact point, speed, spin and any other relevant parameters) may be effectively controlled at the manufacturing stage to provide high and relatively uniform rebound characteristics over a large part of the net area.

The momentary increase in net tension due to ball impact may, due to the mesh arrangement, be substantially confined to bands in diagonal cross formation with the "well" in the intersection, and the relevant regions of the cord are found in the four intersections of the bands with the boundary of the net.

It is also believed that the desirable effects of the invention are best obtained from a net made of filaments which have a particular form of strain/stress (i.e. length/tension) curve combined with a superior "elastic memory" (the lastmentioned taking account of the propensity of the filament to return to its original length when the stress is removed, and the rapidity of this return). Thus, if a filament be progressively stretched under tension, and if on a graph the length of the stretched filament be plotted against the tension producing the stretch, there may come a stage, sufficiently prior to breaking, where the curve suddenly steepens before resuming a gentler slope prior to fracture. In other words, there may be a "critical" tension at which, for the sake of a small further increase in tension, there may be a remarkable increase in length, without loss of elasticity.

It is further believed at this time that when the ball strikes the tensioned net, the net (or part thereof) momentarily deforms or vibrates in a manner which depends inter alia upon the "vertical" and "horizontal" tensions, and the impact speed of the ball. The tensioned net may possess a number of natural modes of vibration, for each of which a point on the net will have a characteristic maximum speed which according to standard theory will probably depend upon the square of the amplitude of vibration at that point. The amplitude will, in general, depend upon the force that originally set up the vibration. It may be possible that optimal rebound characteristics might be achieved by adjusting the resonance or speed characteristics of the net to the ball speed or an anticipated range of ball speeds to be expected from a particular player. Due allowance may need to be made for the fact that during the first half-vibration the net, at the impact point, is loaded by the ball itself.

The adjustment might be achieved by increasing or decreasing the "vertical" and "horizontal" tensions as a function of increase or decrease in the speed or range of speeds wherewith the particular user might be expected to hit balls to the net.

In any event the tension parallel to the longer axis (usually horizontal) may need to be rather greater than the shorter axis tension in order to obtain a substantially circular deformation.

The frame may be a high-tensile construction of predetermined or predeterminable flexibility and vibration characteristics considered apart from the net. It appears at this stage that superior rebound characteristics may be due to an inter-tuning, resonance or multiplier effect between the frame and net as a coupled system, and that the brace configuration of the supporting frame may be significant in constraining the vibration and deformation of the whole frame structure into optimal modes. It also appears that the system may operate after the manner of a bow and (substantially non-elastic) bowstring.

The frame may vary substantially in size, according to the training requirements of a variety of ball sports, without affecting the general rebound characteristics of the device.

Application of relatively high tension, as herein indicated, not only imparts the desired rebound characteristics to the net but also serves to tighten and rigidify the framework. The whole assembly can therefore be made particularly simple, lightweight and portable. Disassembly is equally simple. Again, if clips are used for tensioning, the tensioner may be used if necessary, this time to apply and maintain sufficient tension while clips, or at least the first few clips, are removed.

As stated above, we have found that our device is capable of providing a very high degree of rebound (i.e., with less than twenty percent loss of kinetic energy). At present it is believed that such superior characteristics may be due, at least in part, to the net relieving the ball of much (albeit temporary) deformation that it would experience were it hit against an absolutely unyielding surface.

A further advantage of our device is that the angle of reflection off the net may depend upon the point of impact of the ball. If central, the "reflection" or delivery may be as would be expected from a hard wall. However if the ball strikes nearer the edge of the net, there may be a tendency for it to deflect towards the centre, as if the net were a hard concave surface. This may be due to the asymmetrical tension effect of the mesh on the ball at the moment of impact.

In general, the rebound coefficient may be least in a central region of the net, and the contours of equal rebound coefficient may depend upon the overall shape of the net and the relative "vertical" and "horizontal" tensions. Optimum results for a rectangular net may require a somewhat greater tension along the major axis of the rectangle.

A random element may also be introduced by means of non-planar frames and/or loose corner connexion.

Furthermore, depending upon whether the ball strikes a "hole" or "corner" (knot) part of the mesh, the rebound characteristics (e.g. angle, speed, spin) may change.

It is to be understood that numerous modifications may be made in details of construction and/or design. For example, the frame members may be made to interconnect without the aid of the joining members—which which may be of material other than plastics—at many locations. Also, the form of means for attaching the net to the frame may be altered to suit requirements, there may be extension uprights at the opposite ends for attachment of a loose net—to catch balls which are hit too high—and means for attachment of a lower net to catch balls which are hit too low, and means for attachment of a replica of a net or top tape of a net in such manner as to represent and indicate the location of a tennis net. The frame for supporting the main ent frame may consist of two spaced members of triangular shape, with the base to rest on the ground, and having the net frame hingedly mounted on it near the lower ends of said members. The net frame may have one or more adjusting bars with spaced openings therein to be engaged by pins at an appropriate location on said triangular members. Alternatively, there may be an adjusting screw, with a handle, engaged in a nut mounted on the support frame. Also, if desired, the complete frame, or parts thereof, may be adapted to fold for ease of transportation and/or storage.

To expedite and simplify the setting up and tensioning of the net, and to minimize the number of operations involving separate clips such as shown in FIG. 4, one or more edges or edge portions of the net may, while the net is still loose, be preliminarily attached to the frame by means of hooks or like fastening elements fixed to the frame member(s) themselves, rather than by means of the separate clips. Advantageously the "upper" edge of the net may be the first to be secured in this manner, i.e. to the top member of the frame, and the lower edge may be attached to a movable beam (such as after the manner of a boat sail and boom arrangement) which beam may itself be provided with fastening elements similar to those fixed to the top fixed frame member. The beam may be guided for movement parallel to said member, such as by adapting its ends for movement in vertical guides on the side members of the frame. If desired, then, by the use of fixed fastening elements or separate clips as necessary or desirable, the net can, while loose, be hooked to the fixed frame members and to the aforementioned beam (suitably placed for this purpose), whereafter the net can be tensioned by fitting the ends of the beam in guides respectively associated with the lower ends of the side members of the frame, and by winching the beam bodily downwards until the desired tension is attained. The beam can then be fixed by suitable locking devices so as to become, in effect, the bottom frame member.

As a modification of the foregoing, the tensioning can be effected hydraulically by means of telescoping hydraulically-extendible side frame members.

The inclination of the net frame may be adjustable about vertical and horizontal axis, the former by mounting the frame on a carriage with casters (which also obviously makes it easy to move the device bodily to the desired location) and the latter by providng an horizontally pivoted sub-frame. Such adjustments are useful in order to provide for service practice, with a well directed ball landing in a service court on the server's side of the net, to provide for volley practice, to provide for ground-shot practice and so on. It is also believed the net will be useful for practising spin shots, in that the net will give effect to the spin imparted to a tennis ball. Also, the rebound net may be used for practising bowling, as in cricket; pitching as in baseball; kicking as in football; and for other purposes. A replica of half of a tennis court may be marked out on one side of the net and two opponents may play a game with each restricted in movements to a side of the half-court.

Similar nets may be mounted around the periphery of such a half-court for playing games similar to squash or royal tennis, should such be desired.

For example, one or more rebound walls or nets according to the invention may be used optionally in conjunction with a conventional net, and may constitute one or more walls and/or the roof of an enclosed court for playing a variety of ball-and-racquet games of the tennis/squash variety on indoor or outdoor courts the dimensions of which vary e.g. from those of a full-size tennis court down to those of a standard squash court. The adaptability, flexibility and versatility of our net, combined with the element of unpredictability of rebound direction (depending as to whether the ball hits a mesh "corner" or "hole") makes it possible to plan and organize a large variety of new and interesting games, such as games combining rules and scoring systems of tennis and squash, and providing various playing options, including playing against an opponent across a net the height of which may be variable according to court dimensions, as in tennis or in a playing situation akin to squash. A further important advantage of the invention permits of the simple construction of a continuous rebound wall or device regardless of length of wall and number and size of angles. Thus it may be feasible to enclos variously-sized and shaped courts on all four (or whatever number) sides with a continuous net having substantially the same tension.

A further advantage of our "rebound walls" resides in the possibility of substantially reducing the likelihood of injury to player(s) and/or damage to racquets and other equipment by contact (accidental or otherwise) with the walls, which will tend to absorb and dissipate potentially destructive energy.

It will further be apparent that our walls and ancillary framework and related items can be made of essentially lightweight and hence portable construction.

In addition, it will be seen that the angle of the side and/or end walls of a court can be varied, depending upon the court dimensions and the kind of game to be played. Thus by suitably inclining a front wall of a "half-court", for example, the return or rebound flight may be directed so as to closely simulate that of a ball hit in normal play on a full-court. Additionally or alternatively, the other walls may be variously inclined, vertically and/or horizontally, to "penalize" or "reward" a player who strikes a ball towards, or who permits a ball to rebound off, a particular wall or wall section.

In a standard set-up, all walls could be arranged to slope such that, in geometrical terms, their inward normals are somewhat inclined to the horizontal (the outward normals being consequently and correspondingly declined from, the horizontal). Thus a ball striking any wall would rebound at a somewhat higher angle than had the walls been precisely vertical. This may enable players to engage in longer rallies, and alert them to the principles of correct positional play by encouraging them towards favourable placement of themselves and their strokes.

Yet another advantage of our wall is that its openwork construction permits of a substantially unobstructed view by spectators outside a court. Such privacy as the player(s) may wish, can be provided by means of opaque external screens e.g. of plastics sheeting, or of cloth.

The lightweight and portable nature of our rebound wall construction (and hence of a complete court) may enable a number of courts to be set up on existing indoor or outdoor tennis, basketball or other playing areas. A standard tennis court, for example, might accommodate up to four of our tennis/squash courts, thereby greatly increasing the utility of the space and the playing capacity of public and commercial sporting facilities. Such may lead to the possibility of enhanced cost efficiency of construction per player and improved commercial profitability for a given size of playing area, and of combining the attractive and beneficial features of (e.g.) both tennis and squash with regard to technique, strategy, specific skills, agility, reflexes, aerobic capacity, and other desirable factors.

Furthermore our device is, unlike many prior contrivances, is easy to assemble and dismantle.

The ease and flexibility of construction of the device have substantial domestic advantages. Many residential blocks cannot accommodate conventional tennis courts. The invention enables tennis-like games to be played on variable-dimension courts to meet financial and physical constraints. Portability facilitates transportation during domestic re-locations.

It will be evident that many different shapes and sizes of rebound walls can be provided, such as in a "kit", for setting up courts of various types, with or without standard tennis-type nets. Also provided could be variously shaped and sized sections of prefabricated "mod-grass" or other synthetic "floor" or "ground" surfaces. A typical section might have one or more edge portions in white (or otherwise contrasted to the remainder of the section) so as, in registration with a complementary edge portion of an adjacent section, to provide a composite "line" marking, as on a standard court.

The invention will be a boon to teachers and coaches in a great variety of ball games, leading to more effective and profitable coaching and skill acquisition.

Although the invention has been particularly described in relation to ball games and practice, it is equally applicable to other projectiles of various size, shapes, masses and densities e.g. footballs (inflated or otherwise), "bean-bags" and many others. With appropriate adjustment and/or modifications, the device might be used as a trampoline or like contrivance.

I claim:

1. A ball rebound assembly, comprising (a) a generally rectangular frame including generally horizontal and vertical frame members;

(b) means supporting said frame in a generally upright positin;

(c) a high-tensile net arranged within said frame and including threads interconnected to define a mesh having at the net periphery a plurality of mesh apexes;

(d) a high-tensile perimeter cord threaded in and out through the apexes of the meshes around the periphery of said net, thereby to cause said cord to assume an arcuate configuration between successive connection points, whereby the arc radius increases with increasing cord tension, and vice versa;

(e) means connecting said net to said frame via said cord to cause the rebound assembly to rebound a ball with less than twenty percent loss of kinetic energy, said connecting means including:

(1) a plurality of generally inextensible elements connected between said cord and said frame, respectively, (2) said elements including means for adjusting the position of the cord relative to the associated frame member, (3) said elements maintaining said net under high tension with the threads thereof extending obliquely relative to said frame members, thereby forming, when the assembly is in use, a highly-tensioned system of substantially equal square meshes the diagonals of which extend vertically and horizontally, respectively, (4) said elements being operable to adjust the relative position of the cord engaged therewith, and hence the local configuration of the cord and the balancing tensions in the threads meeting and joined at the apexes through which the cord is threaded, (5) said connecting elements being so distributed around the frame and so fastened and arranged as to provide the desired tensions in the locally-terminating threads and in impact areas corresponding to intersections of contiguous threads.

2. A rebound device as defined in claim 1, wherein the ends of the cord are securely fastened together, whereby the effective perimeter of the net is constant.

3. A rebound device is defined in claim 1, wherein the cord is of monofilament nylon and has a breaking strain exceeding 2700 Newtons.

4. Apparatus as defined in claim 1, wherein said connecting elements comprise clips.

5. A rebound device is defined in claim 4, wherein said adjustment means include a number of spaced jaws in any of which the cord may engage, thereby locally holding the cord at a corresponding distance from the relevant frame member and relieving or increasing the net tension accordingly.

6. A rebound device as defined in claim 4, wherein the force exerted on each clip is not less than 80 Newtons.

7. A rebound device as defined in claim 4, wherein the force exerted on each clip is not less than 120 Newtons.

8. Apparatus defined in claim 4, wherein said clips include at one end a hook portion removably connected with the corresponding frame member, respectively.

9. A rebound device as defined in claim 1, wherein the net is of nylon and the interconnection of the threads is by non-slip knotting.

10. A rebound device as defined in claim 1, and further including connector members assembled to form said frame structure and said supporting means.

* * * * *